US007435892B1

(12) United States Patent
Goin et al.

(10) Patent No.: US 7,435,892 B1
(45) Date of Patent: Oct. 14, 2008

(54) POWER-OPERATED PAGE ROTATING DEVICE

(76) Inventors: Sabrina Goin, 4421 E. Hubbell St., Unit 94, Phoenix, AZ (US) 85008; Sylvia Goin, 1507 E. Gray St., Phoenix, AZ (US) 85042

( * ) Notice: Subject to any disclaimer, the term of this patent is extended or adjusted under 35 U.S.C. 154(b) by 55 days.

(21) Appl. No.: 11/582,884

(22) Filed: Oct. 19, 2006

(51) Int. Cl.
*G10G 7/00* (2006.01)

(52) U.S. Cl. ..... 84/486; 84/487; 40/531

(58) Field of Classification Search ..... 84/486, 84/487; 40/531
See application file for complete search history.

(56) References Cited

U.S. PATENT DOCUMENTS

| | | | | | |
|---|---|---|---|---|---|
| 398,602 | A | * | 2/1889 | Fletcher | 40/500 |
| 578,285 | A | * | 3/1897 | Cheney | 40/500 |
| 876,781 | A | * | 1/1908 | Dorward | 84/498 |
| 978,162 | A | * | 12/1910 | Hopkins | 40/494 |
| 998,265 | A | * | 7/1911 | Schleicher | 84/486 |
| 1,069,122 | A | * | 8/1913 | Friedman | 40/475 |
| 1,157,252 | A | * | 10/1915 | Phillips et al. | 40/531 |
| 1,207,456 | A | * | 12/1916 | Whelan | 40/533 |
| 1,288,197 | A | | 12/1918 | Reynolds | |
| 1,296,725 | A | * | 3/1919 | Wood | 84/486 |
| 1,339,261 | A | * | 5/1920 | Jolley | 84/487 |
| 1,462,715 | A | * | 7/1923 | Mash | 84/486 |
| 1,594,914 | A | * | 8/1926 | Ventrella | 40/531 |
| 1,609,775 | A | * | 12/1926 | Schuchert | 84/502 |
| 1,682,884 | A | * | 9/1928 | Broadley | 40/531 |
| 1,733,176 | A | * | 10/1929 | Winter | 40/494 |
| 3,165,846 | A | * | 1/1965 | Piller | 40/531 |
| 3,281,974 | A | * | 11/1966 | Jensen | 40/531 |
| 3,732,773 | A | * | 5/1973 | Bombardi | 84/491 |
| 3,823,638 | A | * | 7/1974 | Bombardi | 84/503 |
| 4,072,080 | A | * | 2/1978 | Conlin | 84/486 |
| 4,102,070 | A | * | 7/1978 | Simon | 40/498 |
| 4,346,641 | A | | 8/1982 | Kobayashi | |
| 4,882,969 | A | | 11/1989 | Ricca | |
| 4,936,034 | A | * | 6/1990 | Chen et al. | 40/531 |
| 5,373,772 | A | | 12/1994 | Shemoul | |
| D385,900 | S | | 11/1997 | Lyle | |
| 6,215,058 | B1 | * | 4/2001 | Molchak et al. | 84/486 |
| D527,037 | S | * | 8/2006 | Berg | D17/99 |
| 7,145,069 | B2 | * | 12/2006 | Berg | 84/486 |

* cited by examiner

*Primary Examiner*—Lincoln Donovan
*Assistant Examiner*—Robert W Horn

(57) ABSTRACT

A page rotating device includes a planar support plate. A cylindrical housing that has a first longitudinal length is coupled to the support plate. A central shaft has opposed top and bottom ends, has a second longitudinal length, and is rotatably seated within the housing. The second length is shorter than the first length. Page-holding sections are coupled to the central shaft, and have inner linear edges disposed adjacent to the central shaft and seated within the housing. Each page-holding section includes wire ribs attached thereto for preventing the page-holding sections from flexing during rotating movement. A mechanism is included for rotating the page-holding sections about the central shaft such that the inner edges of the page-holding sections travel 180 degrees along an arcuate path. The rotating mechanism rotates the page-holding sections in clockwise and counter clockwise directions when the central shaft is rotated in clockwise and counter clockwise directions.

15 Claims, 4 Drawing Sheets

POWER-OPERATED PAGE ROTATING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to page rotating devices and, more particularly, to a power-operated page rotating device for automatically turning a musicians page during a musical performance.

2. Prior Art

At a recital, and other music performances, it has often been seen that a musician interrupts playing, crouches forward, hurriedly turns the pages of a music book with his hands, and then resumes playing. Alternately, an assistant sitting behind a musician carefully gazes at the music book, and from time to time stands up and turns pages for the musician. Such page turning acts are primitive and troublesome, since no fumbling or mistake is permitted. Numerous inventions have been proposed as better solutions to those problems, but up until now, none are considered good enough in terms of versatility, inconspicuousness, and especially, in reliability.

One prior art example shows a page turning device that is placed on a music stand by a clip. A preformed set of a flat spring mechanism is fixed in an opening which is located in the center of the device. Each spring has a predetermined length; the first spring resting on the page turning device is the shortest. The second spring is longer by a predetermined length. The last spring is the longest. A narrow pocket is located at the bottom of each transparency. Each spring is connected to a transparency. To operate, each transparency is placed behind a page which is to be turned, and with the aid of a clip the transparency and the page are held together.

All the springs are arranged in the unit in the following way: The shortest spring turns the first page; the longest spring turns the last page. The movable unit is connected by a cable to a gear of a toothed gear wheel located in the pedal. Every pedal depression results in a predetermined pull of a cable around the gear, causing the movable unit to move to the right on the device and to release one pressed spring which returns to its initial position, causing a page to be turned. Unfortunately, this device is overly complicated in design and is rather heavy, making the transport thereof difficult. The above-noted example is also limited in the number of sheets that can be held therein by the number of springs that can be incorporated into the device.

Accordingly, a need remains for a power-operated page rotating device in order to overcome the above-noted shortcomings. The present invention satisfies such a need by providing a device that is convenient and easy to use, is portable in nature, is versatile in its uses, and has stress-reducing and performance enhancing qualities. When a musician is required to perform lengthy pieces of music, the page rotating device provides him or her with a convenient, hands-free means of turning the individual pages of sheet music. By simply pressing the control, the performer can turn pages of sheet music without worrying that the sheets might fall from the stand or become rearranged. This eliminates the need for musicians to remove their hands from an instrument in order to turn pages and thus reduces performance anxiety during a show in which page turning is required. The device also eliminates the need to have another individual sitting or standing nearby for the sole purpose of turning pages.

BRIEF SUMMARY OF THE INVENTION

In view of the foregoing background, it is therefore an object of the present invention to provide a power-operated page rotating device. These and other objects, features, and advantages of the invention are provided by a power-operated page turning device for automatically turning a musician's page during a musical performance.

The power-operated page turning device includes a planar rear support plate. An elongated and cylindrical housing is provided that has a first longitudinal length. Such a housing is directly and statically coupled to the support plate. An elongated and rectilinear central shaft has axially opposed top and bottom ends registered along a vertical plane. Such a central shaft has a second longitudinal length and is rotatably seated within the housing. The second longitudinal length is shorter than the first longitudinal length. The central shaft preferably has a threaded outer surface extending along a major portion of the second longitudinal length.

A plurality of page-holding sections are operably coupled to the central shaft. Each of the page-holding sections has an inner linear edge disposed adjacent to the central shaft and extends parallel to the central shaft. Such inner edges of the page-holding sections are seated within the housing. Each of the page-holding sections includes a plurality of non-linear wire ribs attached thereto for advantageously and effectively preventing the page-holding sections from undesirably flexing during rotating movement. Such wire ribs diagonally span along a major length of the page-holding sections. Each of the page-holding sections preferably includes a T-shaped lever registered within the housing and medially located between the interior and exterior walls of the housing. Such a T-shaped lever is rigidly connected directly to a corresponding one of the inner edges in such a manner that the arm engages the T-shaped lever and thereby causes the page-holding section to articulate about the central shaft.

A mechanism is included for selectively rotating the page-holding sections about the central shaft such that the inner edges of the page-holding sections remain equidistantly spaced from the central shaft and travel substantially 180 degrees along an arcuate path. Such a rotating mechanism rotates the page-holding sections in clockwise and counter clockwise directions when the central shaft is rotated in clockwise and counter clockwise directions respectively. The rotating mechanism preferably includes a finger that has a body directly engaged about the central shaft. Such a body is linearly displaced along the central shaft and travels along the second longitudinal length when the central shaft rotates. The finger further has an arm monolithically formed with the body. Such an arm extends laterally and horizontally away from the central shaft and terminates within the housing.

A motor is operably coupled directly to the top end of the central shaft. Such a motor effectively drives the shaft. A controller is electrically mated to the motor. Such a controller is disposed to an exterior of the housing and is tethered to the motor such that a user can conveniently easily operate the motor while playing an instrument. The housing includes an exterior wall provided with a plurality of equidistantly spaced curvilinear slots formed therein. The arm engages the page-holding sections and thereby effectively causes the inner edges to independently articulate about the curvilinear slots and rotate along the arcuate path respectively. The housing may further include an interior wall that is equidistantly spaced about the central shaft and the outer wall respectively. Such an interior wall is provided with a continuous helical groove traveling along the second longitudinal length. The arm is guided along the helical groove when the central shaft is rotated.

The device may further include a telescopic support stand that has a male portion directly coupled to a rear surface of the support plate. Such a support stand further has a female portion provided with a plurality of equidistantly spaced legs such that the support plate can be maintained at a substantially stable position above ground level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
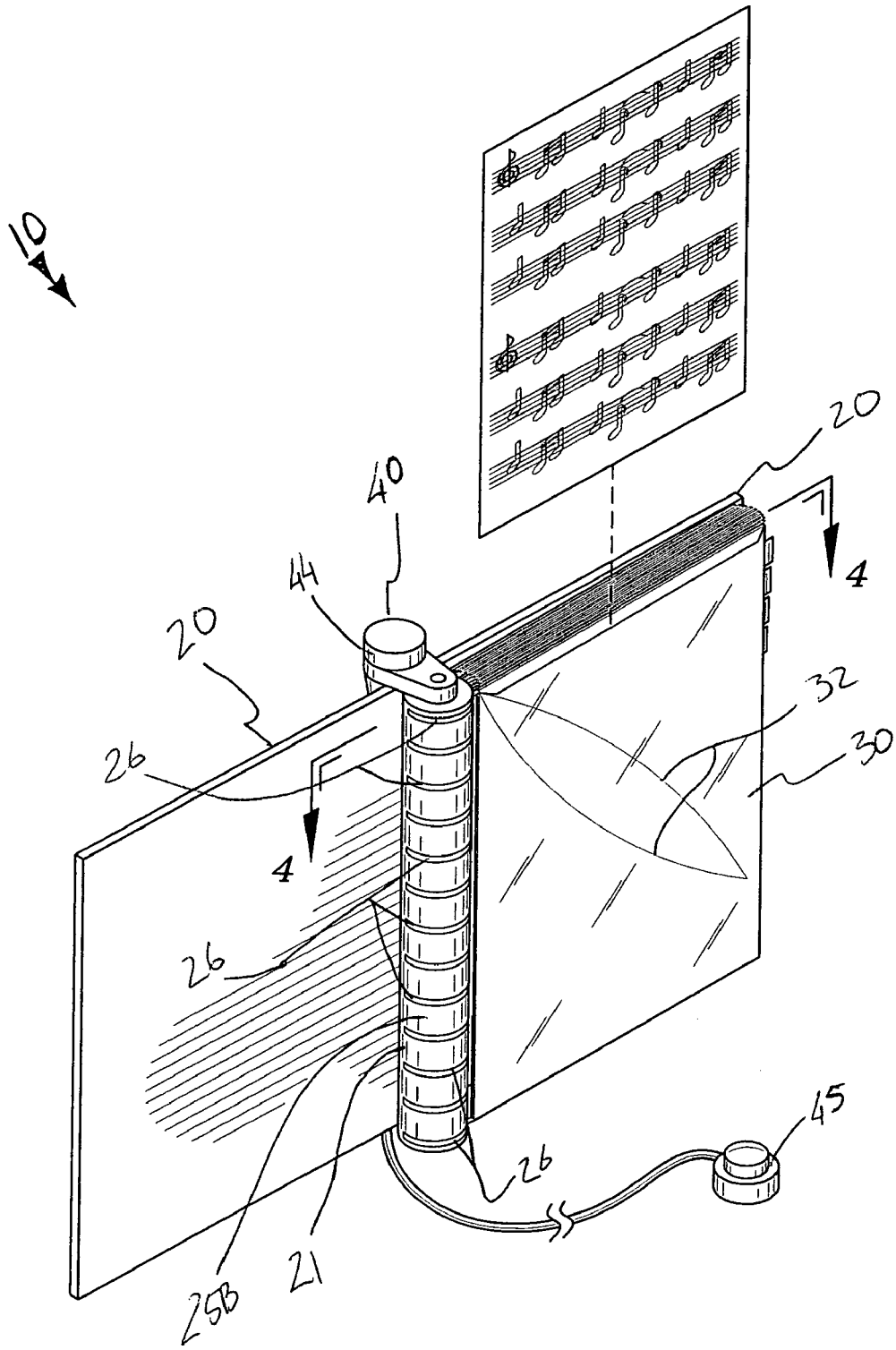
FIG. 1 is a perspective view showing a power-operated page rotating device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-5 by the reference numeral 10 and is intended to provide a power-operated page rotating device. It should be understood that the device 10 may be used to rotate many different types of pages and/or sheets and should not be limited in use to only rotating a musician's sheet music.

Figure 2:
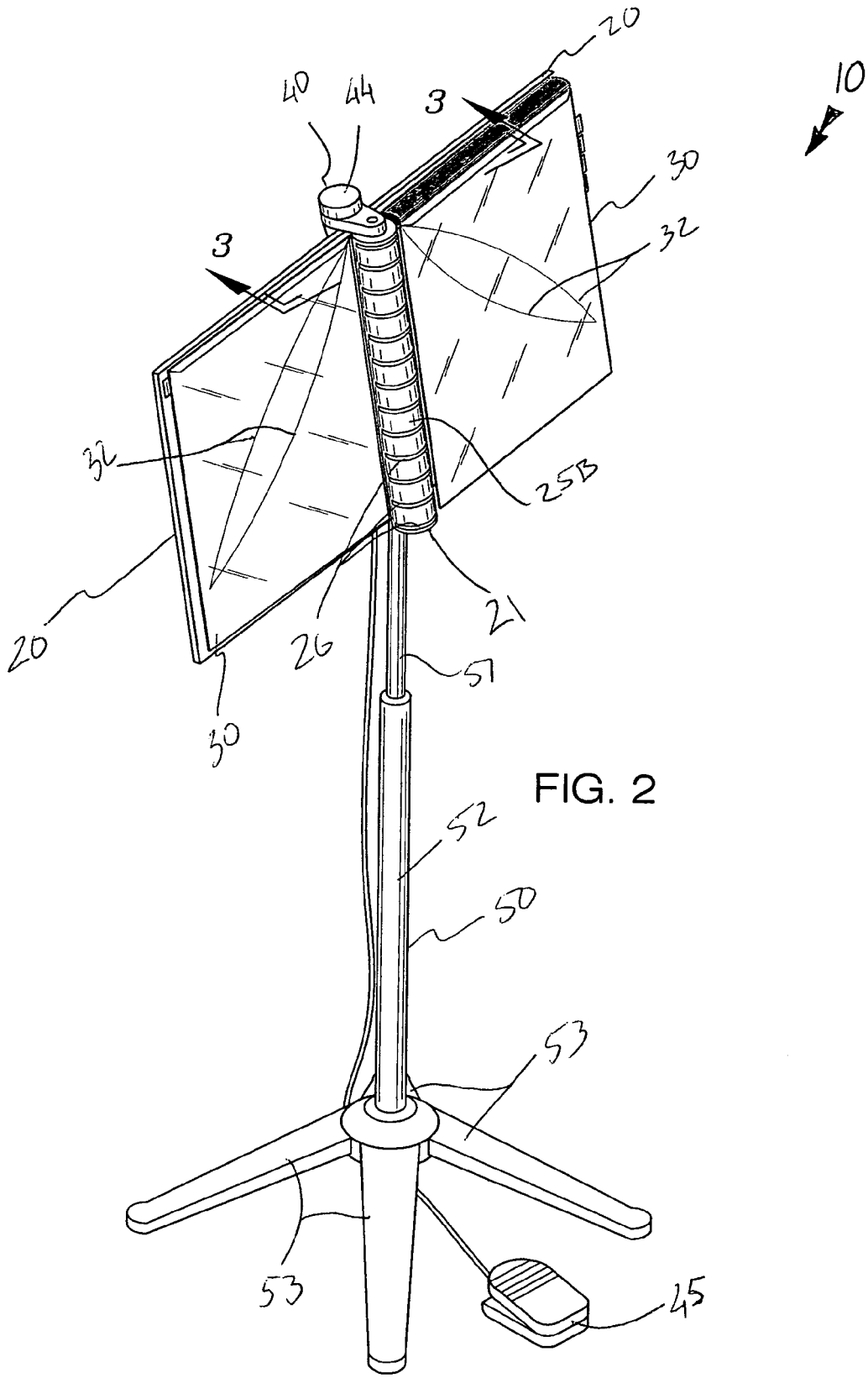
FIG. 2 is a perspective view of the device shown in FIG. 1, showing the device attached to the telescopic support stand.
Figure 3:
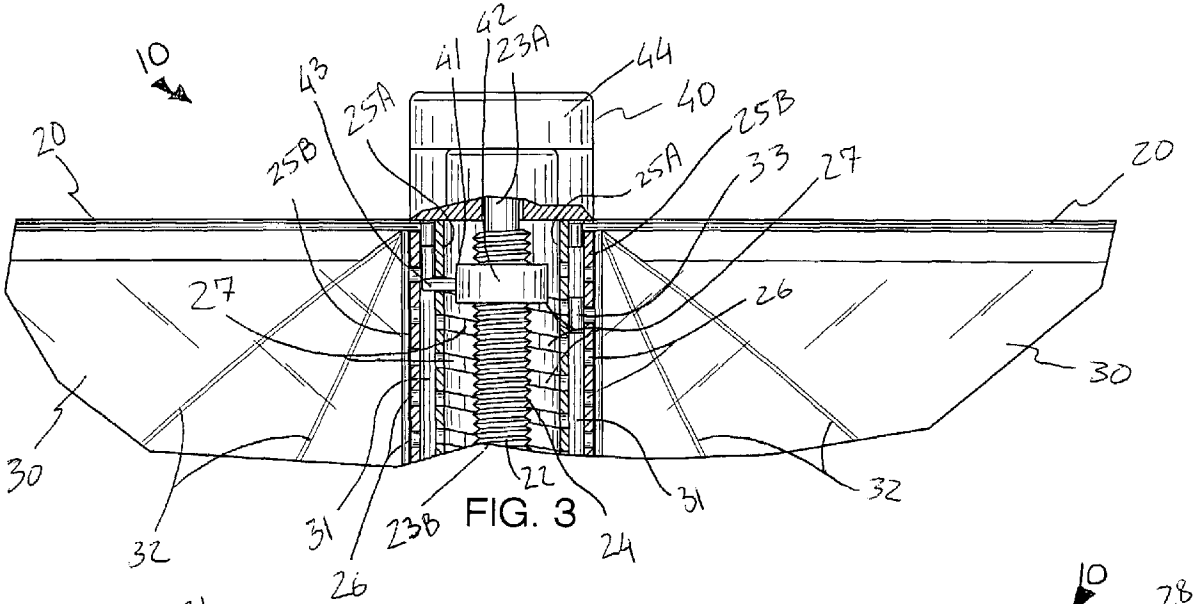
FIG. 3 is a cross-sectional view of the device shown in FIG. 2, taken along lines 3-3.
Figure 4:
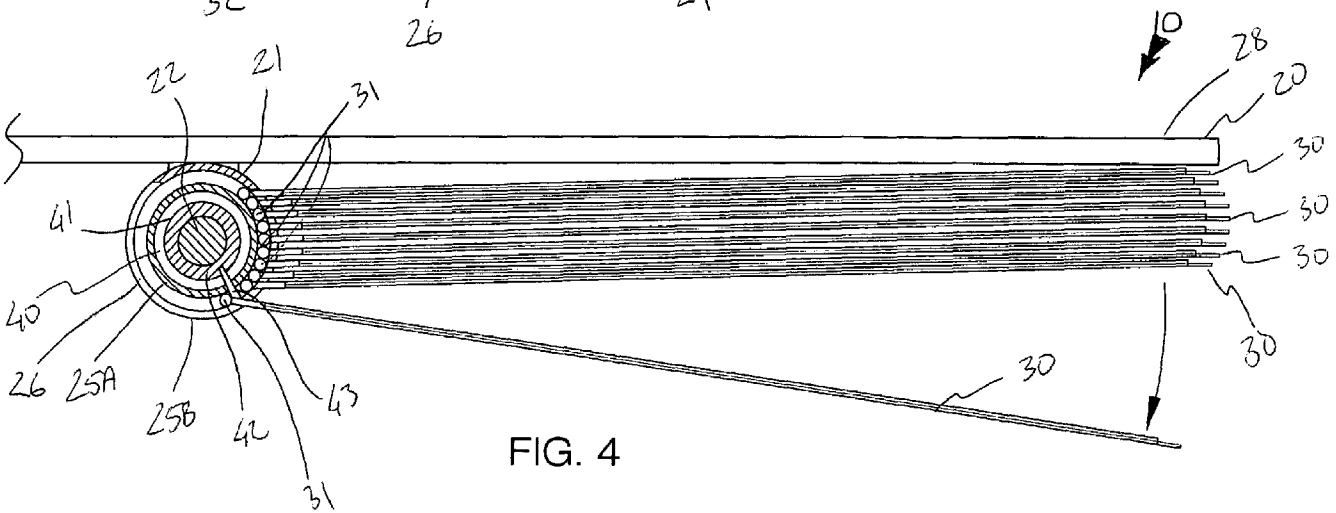
FIG. 4 is a cross-sectional view of the device shown in FIG. 1, taken along line 4-4.

Referring initially to FIGS. 1, 2, 3, 4 and 5, the device 10 includes a planar rear support plate 20. An elongated and cylindrical housing 21 is provided that has a first longitudinal length. Such a housing 21 is directly and statically coupled, without the use of intervening elements, to the support plate 20, as is best shown in FIG. 4. An elongated and rectilinear central shaft 22 has axially opposed top 23A and bottom 23B ends registered along a vertical plane. Such a central shaft 22 has a second longitudinal length and is rotatably seated within the housing 21. The second longitudinal length is shorter than the first longitudinal length, which is crucial for allowing central shaft 22 to become completely disposed within the housing 21. The central shaft 22 has a threaded outer surface 24 extending along a major portion of the second longitudinal length.

Referring to FIGS. 1 through 4, a plurality of page-holding sections 30 are operably coupled to the central shaft 22. Each of the page-holding sections 30 has an inner linear edge 31 disposed adjacent to the central shaft 22 and extending parallel to the central shaft 22. Such inner edges 31 of the page-holding sections 30 are seated within the housing 21, as is illustrated in FIGS. 3 and 4. Each of the page-holding sections 30 includes a plurality of non-linear wire ribs 32 attached thereto that are essential for advantageously and effectively preventing the page-holding sections 30 from undesirably flexing during rotating movement. Such wire ribs 32 diagonally span along a major length of the page-holding sections 30. Each of the page-holding sections 30 includes a T-shaped lever 33 registered within the housing 21 and medially located between the interior 25A and exterior 25B walls of the housing 21. Such a T-shaped lever 33 is rigidly connected directly, without the use of intervening elements, to a corresponding one of the inner edges 31 in such a manner that the arm 43 (described herein below) engages the T-shaped lever 33 and thereby effectively causes the page-holding section 30 to articulate about the central shaft 22.

Referring to FIGS. 3 and 4, a mechanism 40 is included for selectively rotating the page-holding sections 30 about the central shaft 22 such that the inner edges 31 of the page-holding sections 30 remain equidistantly spaced from the central shaft 22 and travel substantially 180 degrees along an arcuate path. Such a rotating mechanism 40 rotates the page-holding sections 40 in clockwise and counter clockwise directions when the central shaft 22 is rotated in clockwise and counter clockwise directions respectively. The rotating mechanism 40 includes a finger 41 that has a body 42 directly engaged, without the use of intervening elements, about the central shaft 22. Such a body 42 is linearly displaced along the central shaft 22 and travels along the second longitudinal length when the central shaft 22 rotates. The finger 41 further has an arm 43 monolithically formed with the body 42. Such an arm 43 extends laterally and horizontally away from the central shaft 22 and terminates within the housing 21.

Referring to FIGS. 1 through 5, a motor 44 is operably coupled directly, without the use of intervening elements, to the top end 23A of the central shaft 22. Such a motor 44 effectively drives the central shaft 22. A controller 45 is electrically mated to the motor 44. Such a controller 45 is disposed to an exterior of the housing 21 and is tethered to the motor 44, which is crucial such that a user can conveniently easily operate the motor 44 while playing an instrument. The housing 21 includes an exterior wall 25B provided with a plurality of equidistantly spaced curvilinear slots 26 formed therein. The arm 43 engages the page-holding sections 30 and thereby effectively causes the inner edges 31 to independently articulate about the curvilinear slots 26 and rotate along the arcuate path respectively. The housing 21 further includes an interior wall 25A that is equidistantly spaced about the central shaft 22 and the outer wall 25B respectively. Such an interior wall 25A is provided with a continuous helical groove 27 traveling along the second longitudinal length. The arm 43 is guided along the helical groove 27 when the central shaft 22 is rotated.

Figure 5:
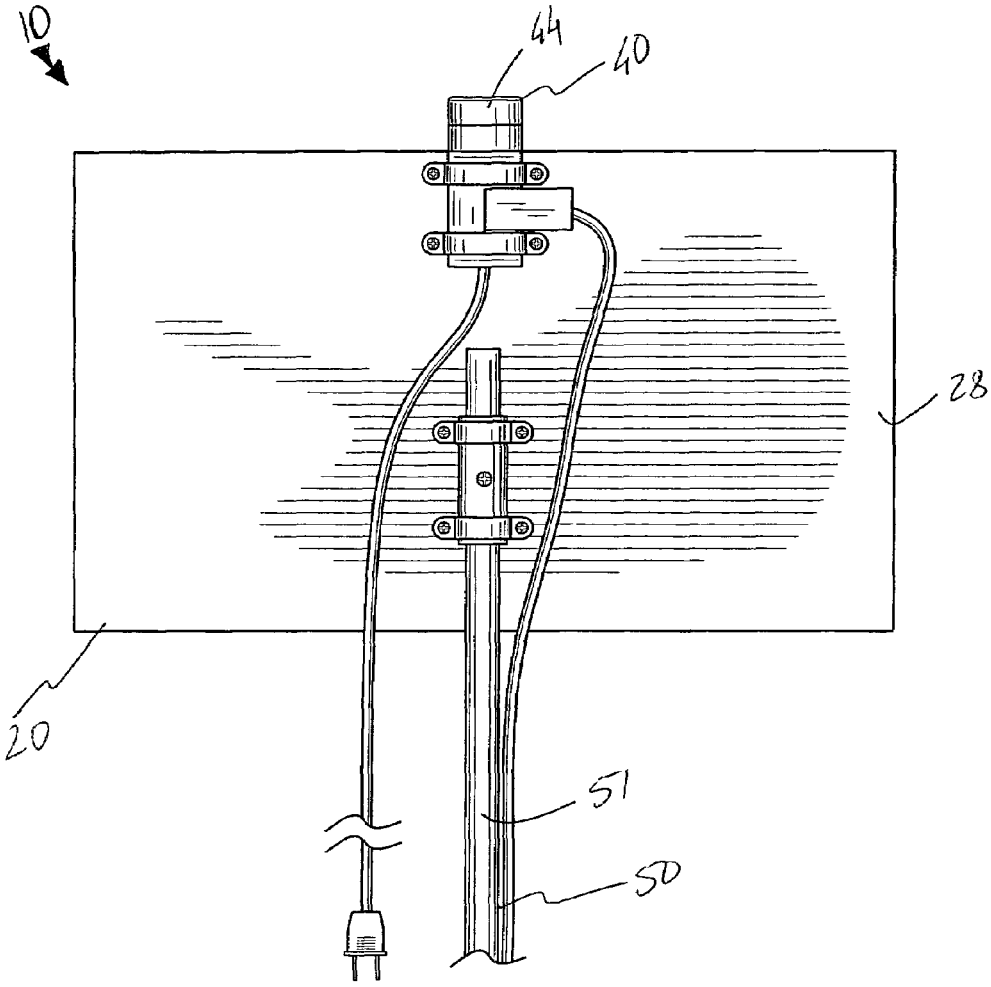
FIG. 5 is a rear-elevational view of the device shown in FIG. 2, showing the planar support plate removed from the telescoping support stand.

Referring to FIGS. 2 and 5, the device 10 further includes a telescopic support stand 50 that has a male portion 51 directly coupled, without the use of intervening elements, to a rear surface 28 of the support plate 20. Such a support stand 50 further has a female portion 52 provided with a plurality of equidistantly spaced legs 53 that are critical such that the support plate 20 can be maintained at a substantially stable position above ground level. The telescoping nature of support stand 50 is vital for allowing a musician to support their sheet music at a convenient and comfortable height, whether they are playing at a seated or a standing position.

In use, when a musician has multiple pages of sheet music for a particular selection or performance, they first place each sheet within a respective page-holding section 30. Once the pages are correctly arranged, the musician can place the support plate 20 on the support stand 50. Of course, the support plate 20 can be placed on the music desk area of a piano, keyboard, etc., as is obvious to a person of ordinary skill in the art. The user then simply activates the device 10, places the controller 45 in a preferred location, places their instrument or hands at the appropriate playing position, and begins their performance. Once the musician reaches the end of the first page they press the controller 45, causing the motor 44 to move the arm 43, and subsequently the page section 30. This effectively and conveniently reveals the next two pages of sheet music, and allows the musician's hands to remain on their instrument. This, in turn, results in a smoother performance by the musician, and provides a stress-free method for rotating their pages of sheet music.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A power-operated page turning device for automatically turning a musicians page during a musical performance, said power-operated page turning device comprising:

a planar rear support plate;

an elongated and cylindrical housing having a first longitudinal length, said housing being directly and statically coupled to said support plate;

an elongated and rectilinear central shaft having axially opposed top and bottom ends registered along a vertical plane, said central shaft having a second longitudinal length and being rotatably seated within said housing, said second longitudinal length being shorter than said first longitudinal length;

a plurality of page-holding sections operably coupled to said central shaft, each of said page-holding sections having an inner linear edge disposed adjacent to said central shaft and extending parallel to said central shaft; and means for selectively rotating said page-holding sections about said central shaft such that said inner edges of said page-holding sections remain equidistantly spaced from said central shaft and travel substantially 180 degrees along an arcuate path;

wherein said rotating means rotates said page-holding sections in clockwise and counter clockwise directions when said central shaft is rotated in clockwise and counter clockwise directions respectively;

wherein said rotating means comprises a finger having a body directly engaged about said central shaft, said body being linearly displaced along said central shaft and traveling along said second longitudinal length when said central shaft rotates, said finger further having an arm monolithically formed with said body, said arm extending laterally and horizontally away from said central shaft and terminating within said housing;

a motor operably coupled directly to said top end of said central shaft, said motor driving said shaft; and a controller electrically mated to said motor, said controller being disposed exterior of said housing and tethered to said motor such that a user can easily operate said motor while playing an instrument;

wherein said housing includes an exterior wall provided with a plurality of equidistantly spaced curvilinear slots formed therein;

wherein said arm engages said page-holding sections and thereby causes said inner edges to independently articulate about said curvilinear slots and rotate along the arcuate path respectively.

2. The device of claim 1, wherein said central shaft has a threaded outer surface extending along a major portion of said second longitudinal length.

3. The device of claim 1, wherein said housing further includes an interior wall equidistantly spaced about said central shaft and said outer wall respectively, said interior wall being provided with a continuous helical groove traveling along said second longitudinal length, said arm being guided along said helical groove when said central shaft is rotated.

4. The device of claim 3, wherein each of said page-holding sections comprises:

a T-shaped lever registered within said housing and medially located between said interior and exterior walls of said housing, said T-shaped lever being rigidly connected directly to a corresponding one of said inner edges in such a manner that said arm engages said T-shaped lever and thereby causes said page-holding section to articulate about said central shaft.

5. The device of claim 1, further comprising: a telescopic support stand having a male portion directly coupled to a rear surface of said support plate, said support stand further having a female portion provided with a plurality of equidistantly spaced legs such that said support plate can be maintained at a substantially stable position above ground level.

6. A power-operated page turning device for automatically turning a musicians page during a musical performance, said power-operated page turning device comprising:

a planar rear support plate;

an elongated and cylindrical housing having a first longitudinal length, said housing being directly and statically coupled to said support plate;

an elongated and rectilinear central shaft having axially opposed top and bottom ends registered along a vertical plane, said central shaft having a second longitudinal length and being rotatably seated within said housing, said second longitudinal length being shorter than said first longitudinal length;

a plurality of page-holding sections operably coupled to said central shaft, each of said page-holding sections being planar, sheet-sized and provided with a sheet holding pocket respectively, each of said page-holding sections having an inner linear edge disposed adjacent to said central shaft and extending parallel to said central shaft, wherein each of said page-holding sections includes a plurality of non-linear wire ribs attached thereto for preventing said page-holding sections from undesirably flexing during rotating movement, said wire ribs diagonally spanning along a major length of said page-holding sections; and means for selectively rotating said page-holding sections about said central shaft such that said inner edges of said page-holding sections remain equidistantly spaced from said central shaft and travel substantially 180 degrees along an arcuate path;

wherein said rotating means rotates said page-holding sections in clockwise and counter clockwise directions when said central shaft is rotated in clockwise and counter clockwise directions respectively;

wherein said rotating means comprises a finger having a body directly engaged about said central shaft, said body being linearly displaced along said central shaft and traveling along said second longitudinal length when said central shaft rotates, said finger further having an arm monolithically formed with said body, said arm extending laterally and horizontally away from said central shaft and terminating within said housing;

a motor operably coupled directly to said top end of said central shaft, said motor driving said shaft; and a controller electrically mated to said motor, said controller being disposed exterior of said housing and tethered to said motor such that a user can easily operate said motor while playing an instrument;

wherein said housing includes an exterior wall provided with a plurality of equidistantly spaced curvilinear slots formed therein;

wherein said arm engages said page-holding sections and thereby causes said inner edges to independently articulate about said curvilinear slots and rotate along the arcuate path respectively.

7. The device of claim 6, wherein said central shaft has a threaded outer surface extending along a major portion of said second longitudinal length.

8. The device of claim 6, wherein said housing further includes an interior wall equidistantly spaced about said central shaft and said outer wall respectively, said interior wall being provided with a continuous helical groove traveling along said second longitudinal length, said arm being guided along said helical groove when said central shaft is rotated.

9. The device of claim 8, wherein each of said page-holding sections comprises:

a T-shaped lever registered within said housing and medially located between said interior and exterior walls of said housing, said T-shaped lever being rigidly connected directly to a corresponding one of said inner edges in such a manner that said arm engages said T-shaped lever and thereby causes said page-holding section to articulate about said central shaft.

10. The device of claim 6, further comprising: a telescopic support stand having a male portion directly coupled to a rear surface of said support plate, said support stand further having a female portion provided with a plurality of equidistantly spaced legs such that said support plate can be maintained at a substantially stable position above ground level.

11. A power-operated page turning device for automatically turning a musicians page during a musical performance, said power-operated page turning device comprising:

a planar rear support plate;

an elongated and cylindrical housing having a first longitudinal length, said housing being directly and statically coupled to said support plate;

an elongated and rectilinear central shaft having axially opposed top and bottom ends registered along a vertical plane, said central shaft having a second longitudinal length and being rotatably seated within said housing, said second longitudinal length being shorter than said first longitudinal length;

a plurality of page-holding sections operably coupled to said central shaft, each of said page-holding sections being planar, sheet-sized and provided with a sheet holding pocket respectively, each of said page-holding sections having an inner linear edge disposed adjacent to said central shaft and extending parallel to said central shaft, wherein said inner edges of said page-holding sections are seated within said housing, wherein each of said page-holding sections includes a plurality of non-linear wire ribs attached thereto for preventing said page-holding sections from undesirably flexing during rotating movement, said wire ribs diagonally spanning along a major length of said page-holding sections; and means for selectively rotating said page-holding sections about said central shaft such that said inner edges of said page-holding sections remain equidistantly spaced from said central shaft and travel substantially 180 degrees along an arcuate path;

wherein said rotating means rotates said page-holding sections in clockwise and counter clockwise directions when said central shaft is rotated in clockwise and counter clockwise directions respectively;

wherein said rotating means comprises a finger having a body directly engaged about said central shaft, said body being linearly displaced along said central shaft and traveling along said second longitudinal length when said central shaft rotates, said finger further having an arm monolithically formed with said body, said arm extending laterally and horizontally away from said central shaft and terminating within said housing;

a motor operably coupled directly to said top end of said central shaft, said motor driving said shaft; and a controller electrically mated to said motor, said controller being disposed exterior of said housing and tethered to said motor such that a user can easily operate said motor while playing an instrument;

wherein said housing includes an exterior wall provided with a plurality of equidistantly spaced curvilinear slots formed therein;

wherein said arm engages said page-holding sections and thereby causes said inner edges to independently articulate about said curvilinear slots and rotate along the arcuate path respectively.

12. The device of claim 11, wherein said central shaft has a threaded outer surface extending along a major portion of said second longitudinal length.

13. The device of claim 11, wherein said housing further includes an interior wall equidistantly spaced about said central shaft and said outer wall respectively, said interior wall being provided with a continuous helical groove traveling along said second longitudinal length, said arm being guided along said helical groove when said central shaft is rotated.

14. The device of claim 13, wherein each of said page-holding sections comprises:

a T-shaped lever registered within said housing and medially located between said interior and exterior walls of said housing, said T-shaped lever being rigidly connected directly to a corresponding one of said inner edges in such a manner that said arm engages said T-shaped lever and thereby causes said page-holding section to articulate about said central shaft.

15. The device of claim 11, further comprising: a telescopic support stand having a male portion directly coupled to a rear surface of said support plate, said support stand further having a female portion provided with a plurality of equidistantly spaced legs such that said support plate can be maintained at a substantially stable position above ground level.

* * * * *